US005769383A

United States Patent [19]

Hemler

[11] Patent Number: 5,769,383

[45] Date of Patent: Jun. 23, 1998

[54] BRUSH RETAINING SYSTEM

[76] Inventor: Thomas C. Hemler, 332 N. Pine St., Lancaster, Pa. 17603

[21] Appl. No.: 753,743

[22] Filed: Nov. 29, 1996

[51] Int. Cl.[6] ..... A46B 17/00

[52] U.S. Cl. ..... 248/682; 248/110; 248/113

[58] Field of Search ..... 248/682, 210, 248/211, 113, 110, 238

[56] References Cited

U.S. PATENT DOCUMENTS

| | | | |
|---|---|---|---|
| 1,754,366 | 4/1930 | Lissy | 248/113 |
| 2,309,990 | 2/1943 | Savi | 248/110 |
| 3,550,887 | 12/1970 | Kwitatkowski | 248/113 |
| 4,991,803 | 2/1991 | Buder | 248/113 |
| 4,993,671 | 2/1991 | Ste. Marie | 248/113 |
| 5,087,014 | 2/1992 | Destjardin | 248/110 |
| 5,406,668 | 4/1995 | Goodhue | 248/110 |

*Primary Examiner*—Victor N. Sakran

[57] ABSTRACT

A new Brush Retaining System for suspending a paint brush over a paint can. The inventive device includes a handle assembly having a clipping means molded integrally therewith.

7 Claims, 3 Drawing Sheets

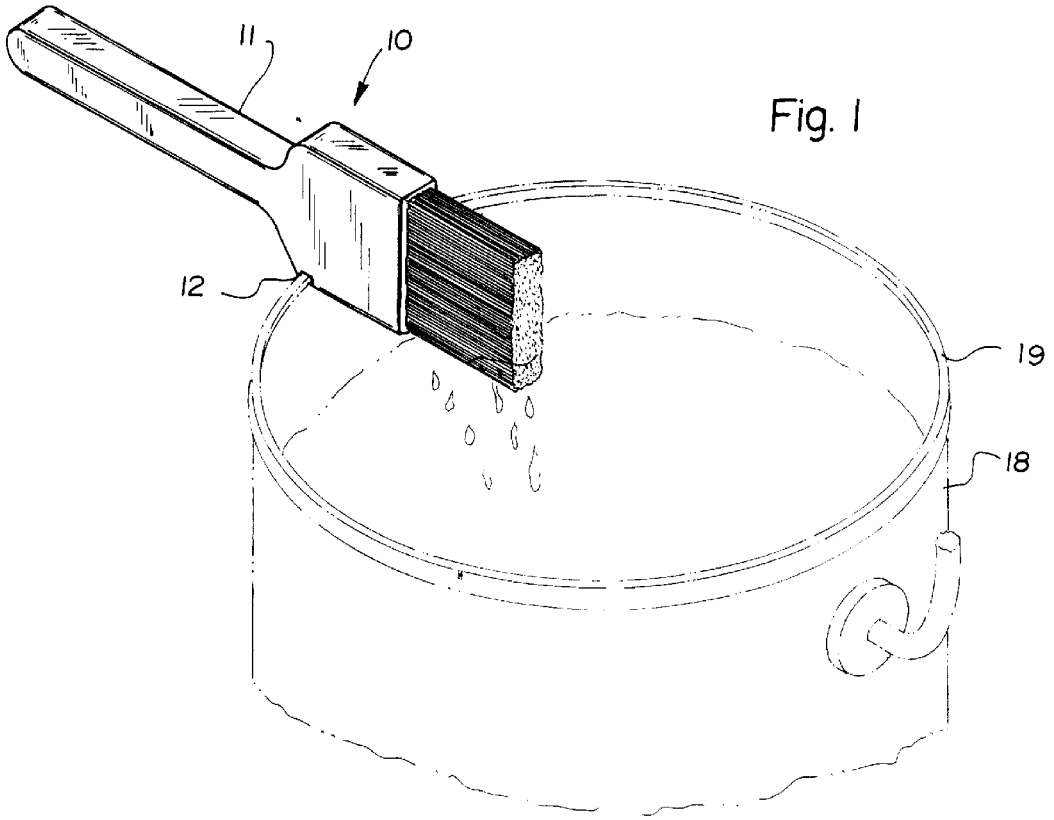
Fig. 1
Fig. 2
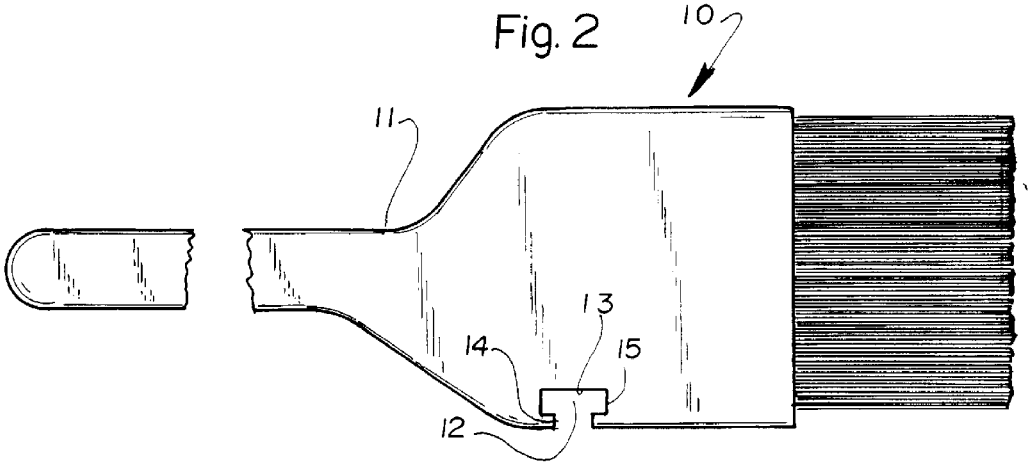

BRUSH RETAINING SYSTEM

BACKGROUND OF THE INVENTION

1. Field of the Invention

The present invention relates to paint brush holders and more particularly pertains to a new Brush Retaining System for suspending a paint brush over a paint can.

2. Description of the Prior Art

The use of paint brush holders is known in the prior art. More specifically, paint brush holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art paint brush holders include U.S. Pat. No. 5,085,386; U.S. Pat. No. 4,991,803; U.S. Pat. No. 4,993,671; U.S. Pat. No. 5,016,773; and U.S. Pat. No. 5,035,386.

While these devices fulfill their respective, particular objectives and requirements, the aforementioned patents do not disclose a new Brush Retaining System. The inventive device includes a handle assembly having a clipping means molded integrally therewith.

In these respects, the Brush Retaining System according to the present invention substantially departs from the conventional concepts and designs of the prior art, and in so doing provides an apparatus primarily developed for the purpose of suspending a paint brush over a paint can.

SUMMARY OF THE INVENTION

In view of the foregoing disadvantages inherent in the known types of paint brush holders now present in the prior art, the present invention provides a new Brush Retaining System construction wherein the same can be utilized for suspending a paint brush over a paint can.

The general purpose of the present invention, which will be described subsequently in greater detail, is to provide a new Brush Retaining System apparatus and method which has many of the advantages of the paint brush holders mentioned heretofore and many novel features that result in a new Brush Retaining System which is not anticipated, rendered obvious, suggested, or even implied by any of the prior art paint brush holders, either alone or in any combination thereof.

To attain this, the present invention generally comprises a handle assembly having a clipping means molded integrally therewith.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Brush Retaining System apparatus and method which has many of the advantages of the paint brush holders mentioned heretofore and many novel features that result in a new Brush Retaining System which is not anticipated, rendered obvious, suggested, or even implied by any of the prior art paint brush holders, either alone or in any combination thereof.

It is another object of the present invention to provide a new Brush Retaining System which may be easily and efficiently manufactured and marketed.

It is a further object of the present invention to provide a new Brush Retaining System which is of a durable and reliable construction.

An even further object of the present invention is to provide a new Brush Retaining System which is susceptible of a low cost of manufacture with regard to both materials and labor, and which accordingly is then susceptible of low prices of sale to the consuming public, thereby making such Brush Retaining System economically available to the buying public.

Still yet another object of the present invention is to provide a new Brush Retaining System which provides in the apparatuses and methods of the prior art some of the advantages thereof, while simultaneously overcoming some of the disadvantages normally associated therewith.

Still another object of the present invention is to provide a new Brush Retaining System for suspending a paint brush over a paint can.

Yet another object of the present invention is to provide a new Brush Retaining System which includes a handle assembly having a clipping means molded integrally therewith.

Still yet another object of the present invention is to provide a new Brush Retaining System that is easy and safe to use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a right side perspective view of a new Brush Retaining System according to the present invention.

FIG. 2 is a plan view thereof.

DESCRIPTION OF THE PREFERRED EMBODIMENT

Figure 3:
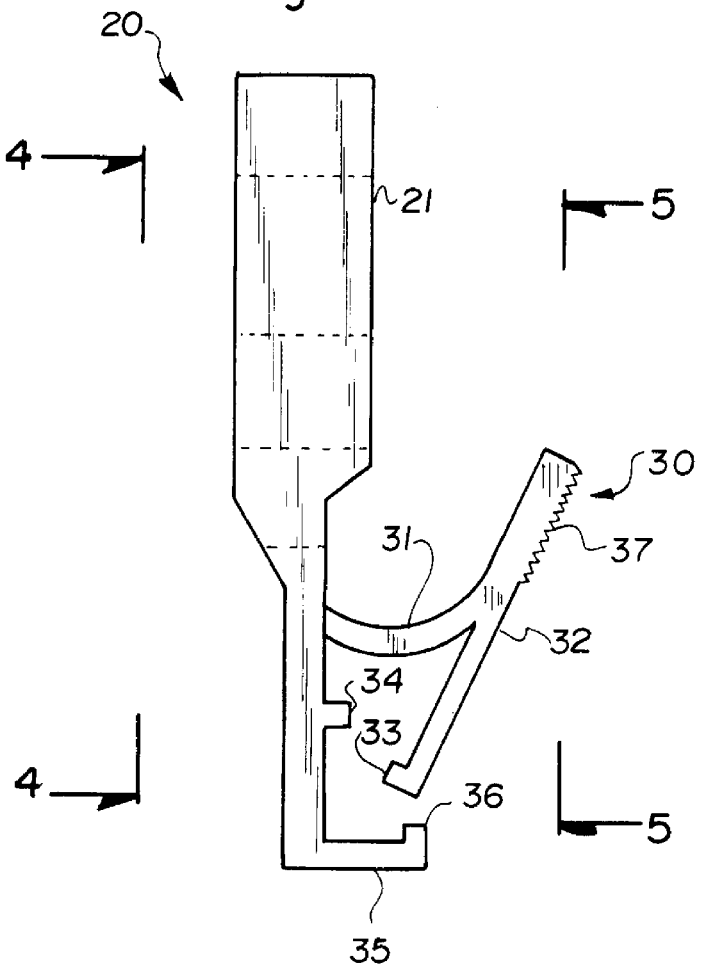
FIG. 3 is a plan view of an alternative embodiment of the present invention.

With reference now to the drawings, and in particular to FIGS. 1 through 6 thereof, a new Brush Retaining System embodying the principles and concepts of the present invention and generally designated by the reference numeral 10 will be described.

More specifically, it will be noted that the Brush Retaining System 10 comprises a paint brush handle assembly and a clipping means integrally molded in the paint brush handle assembly.

With reference to FIG. 1 the Brush Retaining System 10 of the present invention includes a paint brush handle assembly 11 and clipping means 12 integrally molded in the handle assembly that engage a rim 19 of a standard paint can 18.

With reference to FIG. 2 the clipping means 12 include an arcuate notch 13 formed in the paint brush handle assembly 11. The arcuate notch 13 includes a narrow section 14 that engages a bottom surface of the paint can rim 19 and a wide section 15 that engages a top surface of the paint can rim 19.

FIG. 3 shows an alternative embodiment of the present invention. The Brush Retaining System 20 of this embodiment includes a clip body member 21 and a clipping means 30 integrally formed therewith. The clipping means 30 includes a horizontally extending resilient arcuate member 31 fixedly attached to the clip body member 21. The horizontally extending resilient arcuate member 31 has attached thereto a downwardly extending flange 32. The downwardly extending flange 32 exerts a first lateral pressure against an outside surface of the paint can 18 when the Brush Retaining System 20 is clipped to the paint can 18. This first lateral pressure is opposed by a second pressure exerted by a horizontally extending flange 35 disposed on the clip body member 21 below the horizontally extending resilient arcuate member 31, the second pressure being exerted upon an inside surface of the paint can 18.

With continued reference to FIG. 3 the clipping means 30 further includes an outside paint can engaging flange 33 disposed perpendicular to the downwardly extending flange 32 for engaging the outside surface of the paint can, a rim engaging flange 36 disposed perpendicular to the horizontally extending flange 35 for engaging a lower surface of the paint can rim, and a collar 34 disposed on the clip body member 21 between the horizontally extending resilient arcuate member 31 and the horizontally extending flange 35 for engaging a top surface of the paint can rim. Clip engaging member 37 is shown formed at the juncture of the horizontally extending resilient arcuate member 31 and the downwardly extending flange 32 for engaging and disengaging the clipping means 30 from the paint can rim 19 by means for a force exerted by a person, the force causing the horizontally extending resilient arcuate member 31 to deform and remove the first pressure from the outside surface of the paint can.

Figure 4:
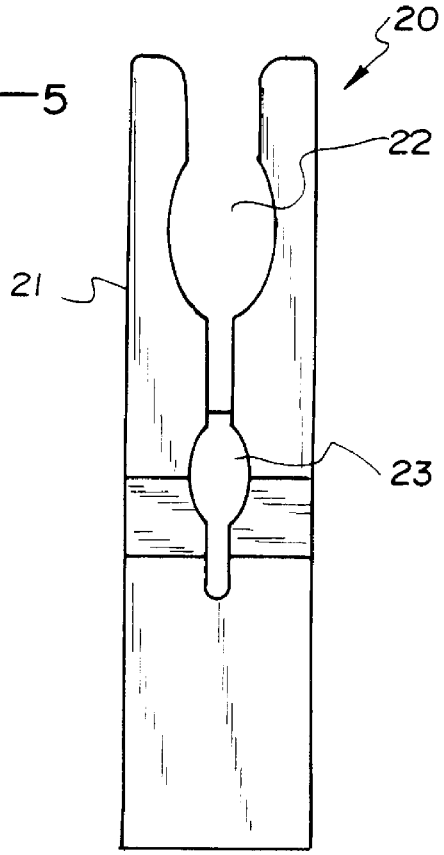
FIG. 4 is a cross sectional view taken along line 4—4 of FIG. 3.
Figure 5:
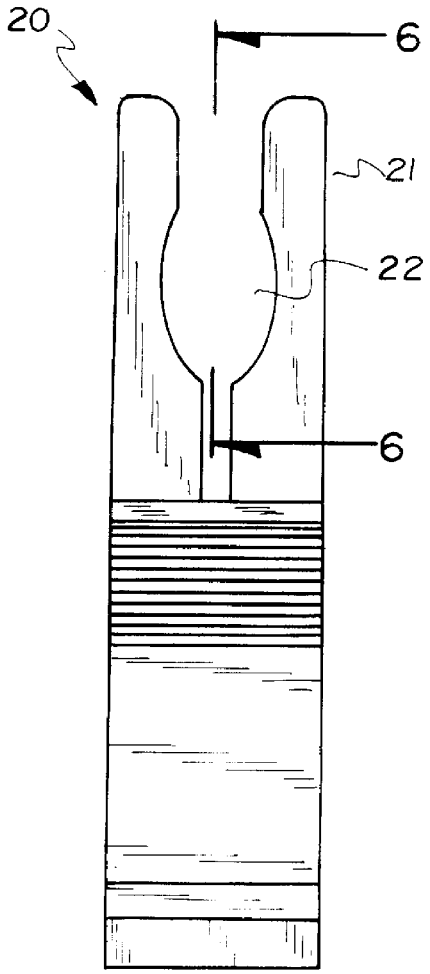
FIG. 5 is a cross sectional view taken along line 5—5 of FIG. 3.
Figure 6:
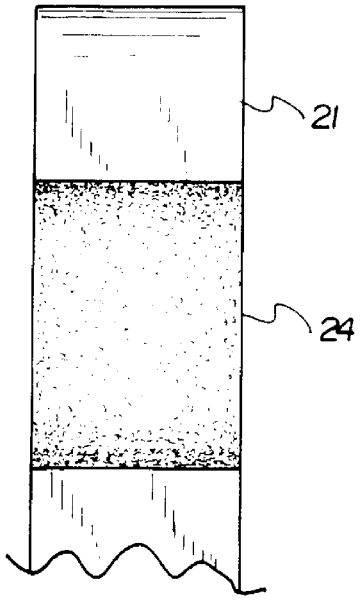
FIG. 6 is a cross sectional view taken along line 6—6 of FIG. 5.

With reference to FIGS. 4–6 a large paint brush receiving means 22 is shown as an aperture formed in the clip body member 21. Also shown is a small paint brush receiving means 23 formed as an aperture in the clip body member 21. An abraded surface 24 helps in securing the paint brush to the clip body member 21 when the paint brush is held therein.

In use, the Brush Retaining System of the first embodiment is clipped to the rim of a paint can by engaging the arcuate notch 13 thereon. The alternative embodiment of the Brush Retaining System 20 is clipped to the rim of a paint can by exerting a force upon the clip engaging member 37 thereby deforming the horizontally extending resilient arcuate member 31 and moving the downwardly extending flange 32 so that the horizontal engaging flange 35 can be inserted into the paint can. Once in the paint can the force upon the clip engaging member 37 is eliminated and the downwardly extending flange 32 and the horizontal engaging flange 35 exert opposing forces upon the sides of the paint can thereby engaging the Brush Retaining System to the paint can. Paint brushes can then be put in the apertures 22 and 23 for storage until needed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A brush retaining system for engaging a rim of a paint can comprising:

a paint brush handle assembly having a handle portion, a pair of broad sides disposed from the handle portion, and a pair of narrow sides disposed from the handle portion; and a clipping means for engaging the rim of the paint can, the clipping means integrally molded in one of the narrow sides such that the broad sides are held in a substantially vertical plane when the clipping means engages the rim of the paint can.

2. The brush retaining system of claim 1, wherein the clipping means further comprises an arcuate notch, the notch comprising a narrow section to engage a bottom surface of the paint can rim and a wide section to engage a top surface of the paint can rim.

3. A brush retaining system comprising:

a clip body member, a clipping means integrally formed therewith, the clip body member further having a paint brush receiving means having an aperture formed in the clip body member, the aperture having an abraded surface:

the clipping means further having a horizontally extending resilient arcuate member fixedly attached to the clip body member, the horizontally extending resilient arcuate member having attached thereto a downwardly extending flange for exerting a first lateral pressure against an outside surface of a paint can in opposition to a second lateral pressure exerted by a horizontally extending flange disposed on the clip body member below the horizontally extending resilient arcuate member, the second lateral pressure exerted by the horizontally extending flange against an inside surface of the paint can.

4. The brush retaining system of claim 3, wherein the clipping means further comprise a collar disposed on the clip body member between the horizontally extending resilient arcuate member and the horizontally extending flange for engaging a top surface of the paint can rim.

5. The brush retaining system of claim 4, wherein the clipping means further comprise a rim engaging disposed perpendicular to the horizontally extending flange for engaging the lower surface of the paint can rim.

6. The brush retaining system of claim 5, wherein the clipping means further comprise an outside can engaging flange disposed perpendicular to the downwardly extending flange for engaging the outside surface of the paint can.

7. The brush retaining system of claim 6, wherein the clipping means further comprise a clip engaging member formed at the juncture of the horizontally extending resilient arcuate member and the downwardly extending flange for engaging and disengaging the clipping means from the paint can by means of a third pressure exerted thereon by a person, the third pressure causing the horizontally extending resilient arcuate member to deform and remove the first pressure from the outside surface of the paint can.

* * * * *